US006384781B1

(12) United States Patent
Kautz et al.

(10) Patent No.: US 6,384,781 B1
(45) Date of Patent: May 7, 2002

(54) METHOD AND APPARATUS FOR CALIBRATING A REMOTE SYSTEM WHICH EMPLOYS COHERENT SIGNALS

(75) Inventors: Gregory Michael Kautz, Burnt Hills; Jeffrey Michael Ashe, Gloversville, both of NY (US); Seth David Silverstein, Charlottesville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/843,439

(22) Filed: Apr. 26, 2001

(51) Int. Cl.[7] ..... H01Q 3/22
(52) U.S. Cl. ..... 342/368; 342/174
(58) Field of Search ..... 342/165, 174, 342/368, 375

(56) References Cited

U.S. PATENT DOCUMENTS 5,572,219 A 11/1996 Silverstein et al.
5,677,696 A * 10/1997 Silverstein et al. ..... 342/360
5,809,087 A * 9/1998 Ashe et al. ..... 375/340

* cited by examiner

*Primary Examiner*—Dao Phan
(74) *Attorney, Agent, or Firm*—Scully, Scott, Murphy & Presser

(57) ABSTRACT

A method for calibrating a remote system having a plurality of N elements, N being a positive integer number. An input signal to each of the N elements is processed according to beamforming bits to determine the output of a corresponding element. The output of the plurality of N elements is a composite signal. The method includes the steps of: (a) transmitting a calibration signal to input the plurality of N elements of the remote system; (b) selecting a first set of beamforming bits for each of the plurality of N elements based upon entries of a predetermined invertible matrix; (c) processing the calibration signal at the remote system according to the beamforming bits for each of the N plurality of elements; (d) detecting a reference signal from the remote system and the composite signal transmitted from the N plurality of elements based on the first set of beamforming bits; (e) repeating steps (b)–(d) for successive sets of beamforming bits to generate a set of signals; and (f) processing the set of signals for generating calibration data for each of the N plurality of elements of the remote system. Preferably, the remote system comprises a phased array system and wherein each of the N plurality of elements comprises an individual antenna in the phased array system.

9 Claims, 1 Drawing Sheet

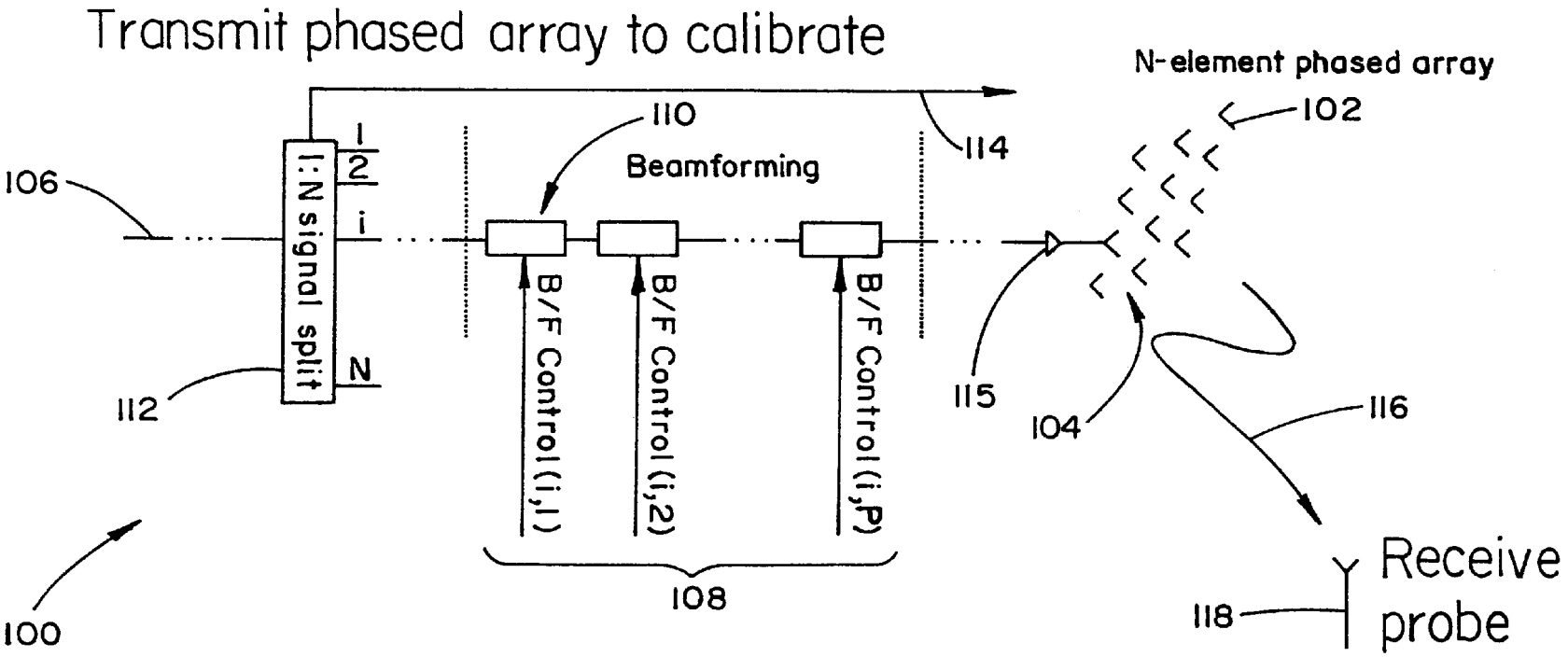
FIGURE

METHOD AND APPARATUS FOR CALIBRATING A REMOTE SYSTEM WHICH EMPLOYS COHERENT SIGNALS

BACKGROUND OF THE INVENTION

1. Field of the Invention

The present invention relates generally to methods and apparatus for calibrating a remote system which employs coherent signals and, more particularly, to a method and apparatus for calibrating a remote phased array system.

2. Prior Art

Active phased array systems or smart antenna systems have the capability for performing programmable changes in the complex gain (amplitude and phase) of the elemental signals that are transmitted and/or received by each respective element of the phased array system to accommodate different beam-forming scenarios. Communications satellites equipped with phased array systems are desirable since satellites so equipped have an intrinsic performance advantage over satellites with conventional reflector antennas. For example, a communications satellite with a phased array system can offer the following advantages: reconfigurable beam patterns ranging from broad-uniform continental coverage down to narrow spot beam patterns with 3 dB widths of about 1 degree; flexibility in varying the level of effective isotropic radiated power (EIRP) in multiple communication channels; and means for providing graceful system performance degradation to compensate for component failures. As conditions for the phased array system in the satellite can change in an unpredictable manner, regularly scheduled calibration for characteristics of the system, such as phase and amplitude characteristics, is generally required to assure optimal system performance.

In order to obtain meaningful estimates of the respective complex gains for the elemental signals respectively formed in each element of the phased array system, the calibration process must be performed in a time window that is sufficiently short so that the complex gains for the respective elemental signals transmitted from each element are substantially quasi-stationary. For a typical geostationary satellite application, the relevant time windows are dominated by two temporally variable effects: changes in the transmitted elemental signals due to variable atmospheric conditions encountered when such signals propagate toward a suitable control station located on Earth; and changes in the relative phase of the transmitted elemental signals due to thermally induced effects in the satellite, such as phase offsets in the respective circuit components for each respective element of the phased array system, and physical warpage of a panel structure employed for supporting the phased array. The thermally induced effects are caused primarily by diurnal variations of the solar irradiance on the phased array panel.

Most calibration techniques of the prior art are essentially variations on the theme of individually measuring, one at a time, the respective complex gain of each single element (SE) of the phased array system while all the other elements of the phased array system are turned off. Although these calibration techniques (herein referred as SE calibration techniques) are conceptually simple, these SE calibration techniques unfortunately have some fundamental problems that make their usefulness questionable for meeting the calibration requirements of typical phased array systems for communications satellites. One problem is the difficulty of implementing a multipole microwave switching device coupled at the front end of the respective electrical paths for each elemental signal so as to direct or route suitable test signals to any single element undergoing calibration. This multipole switching device is typically necessary in the SE calibration techniques to measure the complex gain for the elemental signal respectively formed in any individual element undergoing calibration at any given time. Another problem of the SE calibration techniques is their relatively low signal-to-noise ratio (SNR). This effectively translates into relatively long measurement integration times. At practical satellite power levels, the integration times required to extract the calibration measurements for the SE calibration techniques are often too long to satisfy the quasi-stationarity time window criteria described above. In principle, one could increase the effective SNR of the SE process by increasing the power of the calibration signals transmitted from each element. However, as each element of the phased array system is usually designed to operate at near maximum power, as dictated by the power-handling capacity and linearity constraints for the circuit components in each element, it follows that arbitrary additional increases in power levels are typically not feasible. Thus it is desirable to provide a calibration method that allows for overcoming the problems associated with SE calibration techniques.

Furthermore, U.S. Pat. No. 5,572,219 to Silverstein et al. (hereinafter "Silverstein"), incorporated herein by its reference, discloses methods and apparatus for remotely calibrating a system having a plurality of N elements, such as a phased array system. The method of Silverstein includes generating coherent signals, such as a calibration signal and a reference signal having a predetermined spectral relationship between one another. The calibration signal which is applied to each respective one of the plurality of N elements can be orthogonally encoded based on the entries of a predetermined invertible encoding matrix, such as a binary Hadamard matrix, to generate first and second sets of orthogonally encoded signals. The first and second sets of orthogonally encoded signals and the reference signal are transmitted to a remote location. The transmitted first and second sets of orthogonally encoded signals are coherently detected at the remote location. The coherently detected first and second sets of orthogonally encoded signals are then decoded using the inverse of the predetermined invertible encoding matrix to generate a set of decoded signals. The set of decoded signals is then processed for generating calibration data for each element of the system. Although a significant improvement over the SE calibration techniques of the prior art, the controlled circuit encoding (CCE) techniques of Silverstein can be improved, resulting in a reduced calibration time and lower processing burden.

SUMMARY OF THE INVENTION

Therefore it is an object of the present invention to provide a method and apparatus for calibrating a remote system which remotely estimates the electrical parameters of remote system such as a phased antenna array—namely the complex gain of the quiescent channels and component (discrete) beamforming elements.

It is a further object of the present invention to provide a method and apparatus for calibrating a remote system which requires minimal additional dedicated hardware.

It is yet a further object of the present invention to provide a method and apparatus for calibrating a remote system, such as a phased antenna array and operate within a sufficiently small interval in time to prove valid for arrays operating in a dynamic environment.

The present invention is directed to a method for calibrating remote phased antenna arrays such as those existing on satellite platforms. The method provides estimates of the electrical parameters of an phased antenna array by encoding the elemental signals via selectable devices within the array itself. As a result, the calibration system is composed largely of existing hardware.

The methods of the present invention are a variant of the Silverstein method in which so-termed "Forward" and "Reverse" measurement sets were employed in the calibration process. The methods of the present invention require either of the two data sets. The principal advantage of the methods of the present invention is that the total calibration time may be reduced due to the absence of approximately half the number of device settling interval naturally existing between measurement dwells. The total measurement time, however, remains constant to provide the same parameter estimation accuracy.

Accordingly, a method for calibrating a remote system having a plurality of N elements is provided where N is a positive integer number, an input signal to each of said N elements is processed according to beamforming bits to determine the output of a corresponding element, and the output of the plurality of N elements is a composite signal. The method comprises the steps of: (a) transmitting a calibration signal to input the plurality of N elements of the remote system; (b) selecting a first set of beamforming bits for each of the plurality of N elements based upon entries of a predetermined invertible matrix; (c) processing the calibration signal at the remote system according to the beamforming bits for each of the N plurality of elements; (d) detecting a reference signal from the remote system and the composite signal transmitted from the N plurality of elements based on the first set of beamforming bits; (e) repeating steps (b)–(d) for successive sets of beamforming bits to generate a set of signals; and (f) processing the set of signals for generating calibration data for each of the N plurality of elements of the remote system.

BRIEF DESCRIPTION OF THE DRAWINGS

These and other features, aspects, and advantages of the methods and apparatus of the present invention will become better understood with regard to the following description, appended claims, and accompanying drawing where the FIGURE illustrates a conventional analog beamforming system.

DETAILED DESCRIPTION OF THE PREFERRED EMBODIMENT

Although this invention is applicable to numerous and various types of systems which employ coherent signals (such as coherent electromagnetic signals employed in radar, lidar, communications systems and the like, or coherent sound signals employed in sonar, ultrasound systems and the like), it has been found particularly useful in the environment of phased array systems. Therefore, without limiting the applicability of the invention to phased array systems, the invention will be described in such environment.

Referring now to the FIGURE, consider a general transmitting system 100 of N individual elements 102 placed on an array 104 and driven by a common input signal 106. The array 104 is typically carried by a communication satellite. Note that the technique may equally as well be applied to a passive (receiving) system. As shown in the FIGURE, the array 104 is comprised of multiple antennas 102 that direct energy through selection of independent analog attenuator and phase-shifter devices 108 in each sensor path 110, a single one of which is shown for simplicity. The common input signal, which is referred to as a calibration signal during times of calibration of the array 104 is preferably input into a beam splitter 112 having N+1 outputs corresponding to the N elements 102 of the array 104 and a reference signal 114. The reference signal provides the amplitude, phase, and frequency standard used in the measurement process. Coherency is preserved in the midst of platform motion, dynamic atmospheric variation, etc. Typically, each path 110 of the array will also have an amplifier 115 for amplifying the signal to be transmitted by the corresponding element 102. The output signal of the array 104, also referred to as a composite signal 116, along with the reference signal 114 is detected by a receive probe 118 which is typically part of an earth station which detects the composite and reference signals 114, 116, and processes the same to generate calibration data for each of the N plurality of elements 102 in the array 104.

Each selectable device imparts a specific and constant phase/amplitude variation to the signal. For instance, the common input signal 110 can be attenuated and/or phase shifted for each of the N elements 102 in the array 104. Typically, the amount of phase shift is controlled by any combination of phase shift beamforming bits of 180 degrees, 90 degrees, 45 degrees, 22½ degrees, etc. Similarly, discrete attenuation devices provide amplitude control of sufficient granularity over the operational range of interest. The goal of calibration is to provide a means of (remotely) measuring the gains of the devices, $d_c$, (k), k=1, . . . ; N, v=1, . . . ; L and the quiescent character of the sensor path s(k), k=1, . . . ; N. The channel gain s(k) encompasses the effect of all devices, unrelated to beamforming control, in the path of the signal emitted from sensor k.

The estimation of the complex gain associated with a "calibration-bit" v, $d_v$ (k), k=1, . . . , N will be discussed first, $d_v$ (k) may also consist of a collection of bits (discrete devices). The calibration methodology requires the use of a "toggle-bit" $\mu$ (or collection of beamforming bits) associated with each sensor channel. The associated gain of the toggle-bit which is represented to provide the highest estimation accuracy, is made apparent below. To allow for the estimation of the $v^{th}$, $v^{th}$, v=1, . . . ; L, control bit (or set of bits) across the N participating elements, the following two (noise-free) $N_H$–measurement blocks are necessitated $$y_{\mu 0}(m) = \sum_{k=1}^{N} \alpha(m, k)s(k) \quad m = 1, \ldots, N_H \tag{1}$$

$$y_{\mu v}(m) = \sum_{k=1}^{N} \alpha(m, k)d_v(k)s(k) \quad m = 1, \ldots, N_H \tag{2}$$

where $N_H \geqq N$ and $\alpha$ defines the selection of toggle-bits as related to an $N_H \times N_H$ bipolar matrix H according to $$\begin{aligned} &\alpha(m, k) = 1 && \text{if } H(m, k) = +1 \ \ \mu^{\text{th}} \text{ bit of } k^{\text{th}} \text{ sensor not selected} \\ &\alpha(m, k) = d_\mu(k) && \text{if } H(m, k) = -1 \ \ \mu^{\text{th}} \text{ bit of } k^{\text{th}} \text{ sensor selected} \end{aligned} \tag{3}$$

These are the so-termed "Forward" measurements of Silverstein. As shown in Silverstein, optimum performance, in terms of estimation accuracy, is obtained by selecting the orthogonal Hadamard matrix as the biopolar encoding matrix H. The use of Hadamard encoding matrices is preferable and assumed for purposes of this disclosure. However, other invertible matrices may be used. As is known in the art, if a Hadamard matrix exists, its row size is 1,2, or divisible by 4. For situations where a Hadamard matrix does not exist for precisely the number of elements comprising the array, the next largest Hadamard matrix of size ($N_H \times N_H$) is selected for use. In this case, $N_H - N$ "dummy" elements are said to exist. The procedure calls for additional measurements. However, these measurements enhance the net estimate SNR. In an effort to maintain the same level of estimate accuracy, the effects counterbalance, yielding a somewhat constant total calibration period (neglecting switch settling times).

The inputs to the calibration process are the measurements loaded into the length-$N_H$ vectors having the form $$Y_{\mu 0} = \begin{bmatrix} y_{\mu 0}(1) \\ y_{\mu 0}(2) \\ \vdots \\ y_{\mu 0}(N_H) \end{bmatrix} = \Phi_\mu s \tag{4}$$

$$Y_{\mu v} = \begin{bmatrix} y_{\mu v}(1) \\ y_{\mu v}(2) \\ \vdots \\ y_{\mu v}(N_H) \end{bmatrix} = \Phi_\mu D_v s \tag{5}$$

where $$\phi_\mu = \tfrac{1}{2}(11^T + H) + \tfrac{1}{2}(11^T - H)\, D_\mu, \tag{6}$$

1 is an appropriately-sized vector of ones and $$D_\epsilon = \mathrm{diag}\{d_\epsilon(1), d_\epsilon(2), \ldots, d_\epsilon(N_H)\}. \tag{7}$$

To allow for the use of square matrices in the case where there are dummy elements, the $N_H - N$ corresponding elements of the vectors S and $d_{84}$ are defined to be zero. All Hadamard matrices may be expressed in the form:

$$H^T H = N_H I_{NH} \tag{8}$$

$$[H]_{mn} = +1 \text{ for } m=1 \text{ or } n=1. \tag{9}$$

Deviating from that in Silverstein, the decoded measurements $X_{\mu 0}$ and $X_{\mu v}$ for the new techniques are defined as $$X_{\mu 0} = H^T Y_{\mu 0} = H^T \Phi_\mu S \tag{10}$$

$$X_{\mu v} H^T Y_{\mu v} = H^T \Phi_\mu D_v S. \tag{11}$$

Assuming the use of Hadamard encoding matrices so that Equation (9) applies, the noiseless data structure can be shown to have the form $$X_{\mu 0} = \frac{N_H}{2}(1^T[I_{NH} + D_\mu]s) \begin{bmatrix} 1 \\ 0 \\ \vdots \\ 0 \end{bmatrix} + \frac{N_H}{2}[I_{NH} - D_\mu]s \tag{12}$$

$$X_{\mu v} = \frac{N_H}{2}(1^T[I_{NH} + D_\mu]s) \begin{bmatrix} 1 \\ 0 \\ \vdots \\ 0 \end{bmatrix} + \frac{N_H}{2}[I_{NH} - D_\mu]D_v s. \tag{13}$$

Now assume the existence of such a "spare" signal slot; either by the fact that an N×N Hadamard matrix does not exist or that one is willing to step to the next larger sized matrix. This latter request is reasonable as it is postulated that a Hadamard matrix exists for every multiple of 4. As there is assumed to be zeroed elements of s, let the padded signal vector to be defined according to $$s = \begin{bmatrix} 0 \\ \hline s_N \\ \hline 0_{NH-N-1} \end{bmatrix}, \tag{14}$$

so that (real) elements 1 through N occupy slots 2 through (N+1) of s. If the single-slot offset were not imposed, one would find that the quality of the element #1 gain would be poor compared to those of the rest. The method of Silverstein does not exhibit this behavior.

Notationally, $s_n$ represents the channel gain vector and $D_\mu^N / D_v^N$ represent the toggle/calibration bit gain vectors associated with the N real channels. Notice that the form of $X_{\mu 0}$ and $X_{\mu v}$ reduce nicely to $$X_{\mu 0} = \frac{N_H}{2} \begin{bmatrix} 1^T[I_N + D_\mu^N]s_N \\ \hline [I_N - D_\mu^N]s_N \\ \hline 0_{NH-N-1} \end{bmatrix}, \tag{15}$$

$$X_{\mu v} = \frac{N_H}{2} \begin{bmatrix} 1^T[I_N + D_\mu^N]D_v^N s_N \\ \hline [I_N - D_\mu^N]D_v^N s_N \\ \hline 0_{NH-N-1} \end{bmatrix}.$$

Estimates of the real switch and channel gains are then computed as $$\hat{d}_v^N(k) = \frac{X_{\mu v}(k+1)}{X_{\mu 0}(k+1)} \quad k = 1, \ldots, N \tag{16}$$

$$\hat{s}_N(k) = \frac{X_{\mu 0}(k+1)}{N_H\left(1 - \hat{d}_\mu^N(k)\right)} \quad k = 1, \ldots, N \tag{17}$$

where $\hat{d}_\mu^N(k)$ is a bit-gain estimation from an auxiliary, similarly defined procedure.

Expressions for the bias and variance of the estimate of the control switch complex gain $\hat{d}_v^N(k)$ and quiescent channel gain $S_N(k)$ will now be derived. Although a rigorous analysis of the methods of the present invention have been performed, only a coarse analysis is discussed to convey the main results. This simplistic approach adequately models the intended operation in a sufficiently high SNR scenario.

The actual measurements $\hat{Y}_{\mu 0}$ and $\hat{Y}_{\mu v}$ contain noise originating from external interfering sources, measurement devices, etc. The noise is modeled as additive, zero mean, circular complex Gaussian samples from a white noise process with variance $\sigma^2$. It is easily verified that the transformed noise $n_{\mu 0}$ and $n_{\mu v}$ existing in $X_{\mu 0}$, $X_{\mu v}$ respectively, satisfies $$\begin{aligned} &E\{n_{\mu 0}(k)\} = E\{n_{\mu v}(k)\} = 0 k = 1, \ldots, N_H \\ &E\{|n_{\mu 0}(k)|^2\} = E\{|n_{\mu v}(k)|^2\} = N_H \sigma^2 k = 1, \ldots, N_H \\ &E\{n_{\mu 0}^p(k)\} = E\{n_{\mu v}^p(k)\} = 0 k = 1, \ldots, N_H, p \geq 1 \\ &E\{n_{\mu 0}^p(k) n_{\mu v}^q(l)\} = \{n_{\mu 0}^p(k)[n_{\mu v}^q(l)]^*\} = 0 k, l = 1, \ldots, N_H, p, q \geq 1 \end{aligned} \tag{18}$$

A parameter integration time $T_{meas}$ is assumed which results in a single-element received energy of $E_s = |s(k)|^2$, k =1, . . . ; N. This implies that the calibration of a single-element, performed one at a time, would produce a calibration process operating at a Signal to Noise Ratio, $SNR_{SE}$ of $$SNR_{SE} = E_s / \sigma^2. \tag{19}$$

As with the CCE technique, the approach is to simultaneously use all elements to increase the calibration signal SNR, resulting in a decreased parameter integration time.

Assuming operation in a sufficiently-high SNR regime, the control-bit gain estimator of Equation (16) may adequately be expressed by its first-order series expansion given by $$\hat{d}_v^N(k) = \frac{X_{\mu\nu}(k+1)}{X_{\mu 0}(k+1)} = \frac{d_v^N(k) + \dfrac{2n_{\mu\nu}(k+1)}{N_H(1-d_\mu^N(k))s_N(k)}}{1 + \dfrac{2n_{\mu 0}(k+1)}{N_H(1-d_\mu^N(k))s_N(k)}} \tag{20}$$

$$\approx d_v^N(k) + \frac{2n_{\mu\nu}(k+1)}{N_H(1-d_\mu^N(k))s_N(k)} - \frac{2d_v^N(k)n_{\mu 0}(k+1)}{N_H(1-d_\mu^N(k))s_N(k)} \tag{21}$$

The estimator is seen to be unbiased with variance $$Var\left\{\hat{d}_v^N(k)\right\} = \frac{4\left(1+|d_v^N(k)|^2\right)}{N_H|1-d_\mu^N(k)|^2}\frac{\sigma^2}{E_s}. \tag{22}$$

In a similar fashion, the (unbiased) estimator of the quiescent channel gain $S_n$ (k) is seen to have variance $$Var\{s_N(k)\} = \frac{4\sigma^2\left(2+|d_v^N(k)|^2+|d_\mu^N(k)|^2-2\mathrm{Re}\{d_\mu^N(k)\}\right)}{N_H|1-d_\mu^N(k)|^2|1-d_v^N(k)|^2} \tag{23}$$

As is the case for the CCE technique of Silverstein, the lowest control-bit estimation error is obtained by selecting a π phase-shifter as the toggle-bit. If the π phase shifter is the calibration bit, a collection of other phase-shifter bits most closely providing π shift is chosen. For the sole purpose of obtaining the most accurate estimate of the quiescent channel gain. Equation (23) suggests that the best choices of $\mu$ and ν both be as close to a π phase shift as possible. Equations (22) and (23) are precisely twice the values of those obtained for the methods of Silverstein. To produce an error variance exactly that of the Silverstein methods, the measurement integration time, $T_{meas}$, must be doubled, thus keeping the total measurement dwell time constant. Barring the need to jump to the next larger-sized Hadamard matrix to create an open slot for the dummy element, this technique results in exactly half as many measurements taken over twice the duration. Although the measurement time remains constant, the total calibration time is reduced by eliminating approximately half the number device settling periods.

In summary, the method of the present invention creates a perfect orthogonal transform using imperfect components in all elements controlled by an encoding rule. Upon sensing these composite encodings, the method applies the inverse orthogonal transform to determine each individual elements contribution. The method of the present invention switches each element between a reference state and an encode state based upon the Hadamard Matrix. Measurements are taken of each of the encode states and then decoded by the inverse Hadamard matrix. This simple encoding/decoding procedure makes the method of the present invention extremely attractive for satellite-based active phased array calibration.

The method of the present invention will now be discussed in specific detail with reference to specific examples which are not intended to limit the scope of the present invention.

Model and Definitions

For the procedures we consider an N-element phased array antenna.

Each of the N-elements has a reference complex gain denoted by a(n) for n=1,2, . . . , N.

Each of the N-elements has an encode complex gain denoted by d(n)a(n) for n=1,2, . . . , N. The complex encode value, d(n), can be either a phase change, attenuation change, or a combination of both. Measurements are performed on the composite (superposed) sum of all the elements radiating in either the reference or encode states.

Encoding

The method of the present invention preferably applies the encoding based upon the Hadamard matrix. The first column of the Hadamard matrix contains all +1's. All other rows columns contain an equal number of +1's and −1's. As such, the first column is useless for encoding and not used. The resulting order of the Hadamard matrix, M, to be used for encoding is the smallest existing order that is greater than or equal to N+1. It is believed that Hadamard matrices exist for all orders divisible by 4.

The simplest Hadamard matrix is of order 2:.

$$H_{2M} = \begin{bmatrix} +H_M & +H_M \\ +H_M & -H_M \end{bmatrix}$$

The rows of the Hadamard matrix correspond to the encode states of all elements during a single measurement. The columns of the Hadamard matrix correspond to the encode states of a single element during all measurements. The rule for the n-th element and m-th encoding is given by:

if H(m,n+1)=+1, apply the attenuator in the reference state.

if H(m,n+1)=−1, apply the attenuator in the encode state.

Measurement

Due to the superposition of the element signals during each of the encodings, the m-th measurement of the set is given by:

$$y(m) = \sum_{n=1}^{N}\left(\frac{1+H(m,n+1)}{2}a(n) + \frac{1-H(m,n+1)}{2}d(n)a(n)\right),$$

$$1 \le m \le M$$

We can see this notation follows the encoding rule by observing:

$$\text{if } H(m,n+1) = +1,\ \frac{1+H(m,n+1)}{2} = 1 \text{ and } \frac{1-H(m,n+1)}{2} = 0$$

(send the reference state $a(n)$)

$$\text{if } H(m,n+1) = -1,\ \frac{1+H(m,n+1)}{2} = 0 \text{ and } \frac{1-H(m,n+1)}{2} = 1$$

(send the encode state $d(n)a(n)$)

Each of the M measured values contain information from all of the N elements.

Decoding

The method of the present invention applies the decoding to the measurements based upon the inverse Hadamard matrix. This decoding allows the contributions from all other elements to be removed. In essence, the orthogonality of the Hadamard matrix allows the extraction of each individual element value from the simultaneous measurement of all elements.

$$H_M^{-1} = \frac{1}{M} H_M$$

The k-th decoding of the measurement set is given by:

$$z(k) = \frac{1}{M} \sum_{m=1}^{M} H(m, k+1) y(m), k = 1, 2, \ldots, N$$

substituting the measured value equation into the decoding equation yields:

$$z(k) = \frac{(1 - d(k))a(k)}{2}, k = 1, 2, \ldots, N$$

The decoded value contains information only from the k-th element. This result occurs because of two important properties of the Hadamard matrix: First, each useful row and column has zero mean, and Second, each row and column are orthogonal.

Estimation

Thus far, a signal from a single element was extracted from the composite sum of all signals. The usefulness of this signal is now considered. The experiment sets can be grouped into two major types:

1.) The value of d(k) is known

2.) The value of d(k) is unknown

First, consider the simpler case of knowing the value of the encode value d(k). This could apply to a phase shift, attenuation, or combination of both. Under the assumption that the encode value is known to the precision required:

$$\tilde{d}(k), \approx d(k), k=1,2, \ldots, N$$

The reference gain estimate is determined by:

$$\hat{a}(k) = \frac{2z(k)}{(1 - \tilde{d}(k))}, k = 1, 2, \ldots, N$$

The advantage of knowing the encode value allows the reference state to be estimated in only one measurement set. This requires a multiplication by 2 and a complex divide for each estimate under most conditions. Had the encode value been a perfect 180 degree phase shift, $\tilde{d}(k)=-1$, then no estimation operations are needed:

$$\hat{a}(k)=z(k), k=1,2, \ldots, N$$

Had the encode value been a perfect attenuator, $\tilde{d}(k)=0$, then only a multiply by 2 estimation operation is needed:

$$\hat{a}(k)=2z(k), k=1,2, \ldots, N$$

Now consider the slightly more complex case when the encode value d(k) is unknown. Again, this could apply to a phase shift, attenuation, or combination of both. We need to send additional measurement sets with different settings in order to get estimates of the encode value before estimating the desired reference gain. For the first measurement set choose:

a(n), n=1,2, . . . , N reference gain $d^{(1)}(n)a(n)$, n=1,2, . . . , N encode gain $$z^{(1)}(k) = \frac{(1 - d^{(1)}(k))a(k)}{2}, k = 1, 2, \ldots, N \text{ decoded measurement}$$

For the second measurement set choose:

$d^{(2)}(n)a(n)$, n=1,2, . . . , N reference gain and another control circuit $d^{(1)}(n)d^{(2)}(n)a(n)$, n=1,2, . . . , N encode gain and another control circuit $$z^{(2)}(k) = \frac{(1 - d^{(1)}(k))d^{(2)}(k)a(k)}{2}, k = 1, 2, \ldots, N \text{ decoded measurement}$$

Given these two measurement sets, it is now possible to get an estimate of:

$$\hat{d}^{(2)}(k) = \frac{z^{(2)}(k)}{z^{(1)}(k)}, k = 1, 2, \ldots, N$$

Incorporating a third measurement set by choosing:

a(n), n=1,2, . . . , N reference gain $d^{(2)}(n)a(n)$, n=1,2, . . . , N different encode gain $$z^{(3)}(k) = \frac{(1 - d^{(2)}(k))a(k)}{2}, k = 1, 2, \ldots, N \text{ decoded measurement}$$

It is now possible to get an estimate of:

$$\hat{a}(k) = \frac{2z^{(3)}(k)}{1 - \hat{d}^{(2)}(k)}, k = 1, 2, \ldots, N$$

And resultantly, $$\hat{d}^{(1)}(k) = 1 - \frac{2z^{(1)}(k)}{\hat{a}(k)}, k = 1, 2, \ldots, N$$

Required Measurement Sets

The table contrasts the required number of measurement sets to be taken in order to estimate the reference state and/or a number of phase states.

TABLE

| Estimation Quantity | Known encode gain | Unknown encode gain |
|---|---|---|
| reference state only | 1 set | 3 sets (provides information of 2 other states) |
| reference state and 1 state | 2 sets | 3 sets (provides information of 1 other state) |
| reference state and 2 states | 3 sets | 3 sets |
| reference state and 3 states | 4 sets | 4 sets |
| reference state and P > 1 states | P + 1 sets | P + 1 sets |

Unknown Encoding Gain Example with "Fully Loaded" Hadamard Encoding

As an example consider the case of an N=7 element array. The smallest order Hadamard matrix than can be used is M=8.

Now consider the encoding of element n=1 during each of the M measurements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(:, n+1) = \begin{bmatrix} +1 \\ -1 \\ +1 \\ -1 \\ +1 \\ -1 \\ +1 \\ -1 \end{bmatrix} \begin{matrix} \text{Measurement 1} & \text{Reference State} \\ \text{Measurement 2} & \text{Encode State} \\ \text{Measurement 3} & \text{Reference State} \\ \text{Measurement 4} & \text{Encode State} \\ \text{Measurement 5} & \text{Reference State} \\ \text{Measurement 6} & \text{Encode State} \\ \text{Measurement 7} & \text{Reference State} \\ \text{Measurement 8} & \text{Encode State} \end{matrix}$$

Also consider the encoding of element n=5 during each of the M measurements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(:, n+1) = \begin{bmatrix} +1 \\ -1 \\ +1 \\ -1 \\ -1 \\ +1 \\ -1 \\ +1 \end{bmatrix} \begin{matrix} \text{Measurement 1} & \text{Reference State} \\ \text{Measurement 2} & \text{Encode State} \\ \text{Measurement 3} & \text{Reference State} \\ \text{Measurement 4} & \text{Encode State} \\ \text{Measurement 5} & \text{Encode State} \\ \text{Measurement 6} & \text{Reference State} \\ \text{Measurement 7} & \text{Encode State} \\ \text{Measurement 8} & \text{Reference State} \end{matrix}$$

Now consider the measurement m=1 from all of the N elements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(m;:) = [\,+1 \quad +1 \quad +1 \quad +1 \quad +1 \quad +1 \quad +1 \quad +1\,]$$

$$y(1) = 0 + a(1) + a(2) + a(3) + a(4) + a(5) + a(6) + a(7)$$

Also consider the measurement m=5 from all of the N elements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(m, :) = [\,+1 \quad +1 \quad +1 \quad +1 \quad -1 \quad -1 \quad -1 \quad -1\,]$$

$$y(5) = 0 + a(1) + a(2) + a(3) + d(4)a(4) + d(5)a(5) + d(6)a(6) + d(7)a(7)$$

The complete superposed M=8 measurement set consists of:

$$y(1) = a(1) + a(2) + a(3) + a(4) + a(5) + a(6) + a(7)$$

$$y(2) = d(1)a(1) + a(2) + d(3)a(3) + d(5)a(5) + a(6) + d(7)a(7)$$

$$y(3) = a(1) + d(2)a(2) + d(3)a(3) + a(4) + a(5) + d(6)a(6) + d(7)a(7)$$

$$y(4) = d(1)a(1) + d(2)a(2) + a(3) + a(4) + d(5)a(5) + d(6)a(6) + a(7)$$

$$y(5) = a(1) + a(2) + a(3) + d(4)a(4) + d(5)a(5) + d(6)a(6) + d(7)a(7)$$

$$y(6) = d(1)a(1) + a(2) + d(3)a(3) + d(4)a(4) + a(5) + d(6)a(6) + a(7)$$

$$y(7) = a(1) + d(2)a(2) + d(3)a(3) + d(4)a(4) + d(5)a(5) + a(6) + a(7)$$

$$y(8) = d(1)a(1) + d(2)a(2) + a(3) + d(4)a(4) + a(5) + a(6) + d(7)a(7)$$

Now consider the decoding k=1 of the M=8 measurements:

$$H^{-1} = \frac{1}{8}\begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H^{-1}(k+1, :) = \frac{1}{8}[\,+1 \quad -1 \quad +1 \quad -1 \quad +1 \quad -1 \quad +1 \quad -1\,]$$

$$z(1) = 1/8(y(1) - y(2) + y(3) - y(4) + y(5) - y(6) + y(7) - y(8))$$

$$z(1) = 1/2(1 - d(1))a(1)$$

Also consider the decoding k=5 of the M=8 measurements:

$$H^{-1} = \frac{1}{8}\begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H^{-1}(k+1,:) = \frac{1}{8}[\,+1 \quad -1 \quad +1 \quad -1 \quad -1 \quad +1 \quad -1 \quad +1\,]$$

$$z(5) = 1/8(y(1) - y(2) + y(3) - y(4) - y(5) + y(6) - y(7) + y(8))$$

$$z(5) = 1/2(1 - d(5))a(5)$$

The complete decoded N=7 element set consists of:

z(1)=(1/2) (1−d(1))a(1)

z(2)=(1/2) (1−d(2))a(2)

z(3)=(1/2) (1−d(3))a(3)

z(4)=(1/2) (1−d(4))a(4)

z(5)=(1/2) (1−d(5))a(5)

z(6)=(1/2) (1−d(6))a(6)

z(7)=(1/2) (1−d(7))a(7)

The estimates are then derived based upon the known or unknown conditions of the encode values.

Unknown Encoding Gain Example with "Lightly Loaded" Hadamard Encoding

As a second example consider the case of an N=5 element array. Again, the smallest order Hadamard matrix than can be used is M=8:

Now consider the encoding of element n=1 during each of the M measurements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(:, n+1) = \begin{bmatrix} +1 \\ -1 \\ +1 \\ -1 \\ +1 \\ -1 \\ +1 \\ -1 \end{bmatrix} \begin{matrix} \text{Measurement 1} & \text{Reference State} \\ \text{Measurement 2} & \text{Encode State} \\ \text{Measurement 3} & \text{Reference State} \\ \text{Measurement 4} & \text{Encode State} \\ \text{Measurement 5} & \text{Reference State} \\ \text{Measurement 6} & \text{Encode State} \\ \text{Measurement 7} & \text{Reference State} \\ \text{Measurement 8} & \text{Encode State} \end{matrix}$$

Also consider the encoding of element n=5 during each of the M measurements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(:, n+1) = \begin{bmatrix} +1 \\ -1 \\ +1 \\ -1 \\ -1 \\ +1 \\ -1 \\ +1 \end{bmatrix} \begin{matrix} \text{Measurement 1} & \text{Reference State} \\ \text{Measurement 2} & \text{Encode State} \\ \text{Measurement 3} & \text{Reference State} \\ \text{Measurement 4} & \text{Encode State} \\ \text{Measurement 5} & \text{Encode State} \\ \text{Measurement 6} & \text{Reference State} \\ \text{Measurement 7} & \text{Encode State} \\ \text{Measurement 8} & \text{Reference State} \end{matrix}$$

Now consider the measurement m=1 from all of the N elements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(m,:) = [\,+1 \quad +1 \quad +1 \quad +1 \quad +1 \quad +1 \quad +1 \quad +1\,]$$

$$y(1) = 0 + a(1) + a(2) + a(3) + a(4) + a(5) + 0 + 0$$

Also consider the measurement m=5 from all of the N elements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(m,:) = [\,+1 \quad +1 \quad +1 \quad +1 \quad -1 \quad -1 \quad -1 \quad -1\,]$$

$$y(5) = 0 + a(1) + a(2) + a(3) + d(4)a(4) + d(5)a(5) + 0 + 0$$

The complete superposed M=8 measurement set consists of:

$$
\begin{aligned}
y(1) &= a(1) + a(2) + a(3) + a(4) + a(5) \\
y(2) &= d(1)a(1) + a(2) + d(3)a(3) + a(4) + d(5)a(5) \\
y(3) &= a(1) + d(2)a(2) + d(3)a(3) + a(4) + a(5) \\
y(4) &= d(1)a(1) + d(2)a(2) + a(3) + a(4) + d(5)a(5) \\
y(5) &= a(1) + a(2) + a(3) + d(4)a(4) + d(5)a(5) \\
y(6) &= d(1)a(1) + a(2) + d(3)a(3) + d(4)a(4) + a(5) \\
y(7) &= a(1) + d(2)a(2) + d(3)a(3) + d(4)a(4) + d(5)a(5) \\
y(8) &= d(1)a(1) + d(2)a(2) + a(3) + d(4)a(4) + a(5)
\end{aligned}
$$

Now consider the decoding k=1 of the M=8 measurements:

$$
H^{-1} = 1/8 \begin{bmatrix}
+1 & +1 & +1 & +1 & +1 & +1 & +1 & +1 \\
+1 & -1 & +1 & -1 & +1 & -1 & +1 & -1 \\
+1 & +1 & -1 & -1 & +1 & +1 & -1 & -1 \\
+1 & -1 & -1 & +1 & +1 & -1 & -1 & +1 \\
+1 & +1 & +1 & +1 & -1 & -1 & -1 & -1 \\
+1 & -1 & +1 & -1 & -1 & +1 & -1 & +1 \\
+1 & +1 & -1 & -1 & -1 & -1 & +1 & +1 \\
+1 & -1 & -1 & +1 & -1 & +1 & +1 & -1
\end{bmatrix}
$$

$$
\begin{aligned}
&H^{-1}(k+1, :) = 1/8[\,+1 \quad -1 \quad +1 \quad -1 \quad +1 \quad -1 \quad +1 \quad -1\,] \\
&z(1) = 1/8(y(1) - y(2) + y(3) - y(4) + y(5) - y(6) + y(7) - y(8)) \\
&z(1) = 1/2(1 - d(1))a(1)
\end{aligned}
$$

Also consider the decoding k=5 of the M=8 measurements:

$$
H^{-1} = 1/8 \begin{bmatrix}
+1 & +1 & +1 & +1 & +1 & +1 & +1 & +1 \\
+1 & -1 & +1 & -1 & +1 & -1 & +1 & -1 \\
+1 & +1 & -1 & -1 & +1 & +1 & -1 & -1 \\
+1 & -1 & -1 & +1 & +1 & -1 & -1 & +1 \\
+1 & +1 & +1 & +1 & -1 & -1 & -1 & -1 \\
+1 & -1 & +1 & -1 & -1 & +1 & -1 & +1 \\
+1 & +1 & -1 & -1 & -1 & -1 & +1 & +1 \\
+1 & -1 & -1 & +1 & -1 & +1 & +1 & -1
\end{bmatrix}
$$

$$
\begin{aligned}
&H^{-1}(k+1, :) = 1/8[\,+1 \quad -1 \quad +1 \quad -1 \quad -1 \quad +1 \quad -1 \quad +1\,] \\
&z(5) = 1/8(y(1) - y(2) + y(3) - y(4) - y(5) + y(6) - y(7) + y(8)) \\
&z(5) = 1/2(1 - d(5))a(5)
\end{aligned}
$$

The complete decoded N=5 element set consists of:

z(1)=(1/2) (1−d(1))a(1)
z(2)=(1/2) (1−d(2))a(2)
z(3)=(1/2) (1−d(3))a(3)
z(4)=(1/2) (1−d(4))a(4)
z(5)=(1/2) (1−d(5))a(5)

The estimates are then derived based upon the known or unknown conditions of the encode values.

Known encoding (gain=0) Example with "Fully Loaded" Hadamard Encoding

As an example consider the case of an N=7 element array. The smallest order Hadamard matrix than can be used is M=8.

Now consider the encoding of element n=1 during each of the M measurements:

$$
H = \begin{bmatrix}
+1 & +1 & +1 & +1 & +1 & +1 & +1 & +1 \\
+1 & -1 & +1 & -1 & +1 & -1 & +1 & -1 \\
+1 & +1 & -1 & -1 & +1 & +1 & -1 & -1 \\
+1 & -1 & -1 & +1 & +1 & -1 & -1 & +1 \\
+1 & +1 & +1 & +1 & -1 & -1 & -1 & -1 \\
+1 & -1 & +1 & -1 & -1 & +1 & -1 & +1 \\
+1 & +1 & -1 & -1 & -1 & -1 & +1 & +1 \\
+1 & -1 & -1 & +1 & -1 & +1 & +1 & -1
\end{bmatrix}
$$

$$
H(:, n+1) = \begin{bmatrix} +1 \\ -1 \\ +1 \\ -1 \\ +1 \\ -1 \\ +1 \\ -1 \end{bmatrix}
\begin{array}{ll}
\text{Measurement 1} & \text{Reference State} \\
\text{Measurement 2} & \text{Off State} \\
\text{Measurement 3} & \text{Reference State} \\
\text{Measurement 4} & \text{Off State} \\
\text{Measurement 5} & \text{Reference State} \\
\text{Measurement 6} & \text{Off State} \\
\text{Measurement 7} & \text{Reference State} \\
\text{Measurement 8} & \text{Off State}
\end{array}
$$

Also consider the encoding of element n=5 during each of the M measurements:

$$
H = \begin{bmatrix}
+1 & +1 & +1 & +1 & +1 & +1 & +1 & +1 \\
+1 & -1 & +1 & -1 & +1 & -1 & +1 & -1 \\
+1 & +1 & -1 & -1 & +1 & +1 & -1 & -1 \\
+1 & -1 & -1 & +1 & +1 & -1 & -1 & +1 \\
+1 & +1 & +1 & +1 & -1 & -1 & -1 & -1 \\
+1 & -1 & +1 & -1 & -1 & +1 & -1 & +1 \\
+1 & +1 & -1 & -1 & -1 & -1 & +1 & +1 \\
+1 & -1 & -1 & +1 & -1 & +1 & +1 & -1
\end{bmatrix}
$$

$$
H(:, n+1) = \begin{bmatrix} +1 \\ -1 \\ +1 \\ -1 \\ -1 \\ +1 \\ -1 \\ +1 \end{bmatrix}
\begin{array}{ll}
\text{Measurement 1} & \text{Reference State} \\
\text{Measurement 2} & \text{Off State} \\
\text{Measurement 3} & \text{Reference State} \\
\text{Measurement 4} & \text{Off State} \\
\text{Measurement 5} & \text{Off State} \\
\text{Measurement 6} & \text{Reference State} \\
\text{Measurement 7} & \text{Off State} \\
\text{Measurement 8} & \text{Reference State}
\end{array}
$$

Now consider the measurement m=1 from all of the N elements:

$$
H = \begin{bmatrix}
+1 & +1 & +1 & +1 & +1 & +1 & +1 & +1 \\
+1 & -1 & +1 & -1 & +1 & -1 & +1 & -1 \\
+1 & +1 & -1 & -1 & +1 & +1 & -1 & -1 \\
+1 & -1 & -1 & +1 & +1 & -1 & -1 & +1 \\
+1 & +1 & +1 & +1 & -1 & -1 & -1 & -1 \\
+1 & -1 & +1 & -1 & -1 & +1 & -1 & +1 \\
+1 & +1 & -1 & -1 & -1 & -1 & +1 & +1 \\
+1 & -1 & -1 & +1 & -1 & +1 & +1 & -1
\end{bmatrix}
$$

$$
\begin{aligned}
&H(m, :) = [\,+1 \quad +1 \quad +1 \quad +1 \quad +1 \quad +1 \quad +1 \quad +1\,] \\
&y(1) = 0 + a(1) + a(2) + a(3) + a(4) + a(5) + a(6) + a(7)
\end{aligned}
$$

Also consider the measurement m=5 from all of the N elements:

$$H=\begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(m,\ :)=[\,+1\quad +1\quad +1\quad +1\quad -1\quad -1\quad -1\quad -1\,]$$

$$y(5)=0+a(1)+a(2)+a(3)+0+0+0+0$$

The complete superposed M=8 measurement set consists of:

$$y(1)=a(1)+a(2)+a(3)+a(4)+a(5)+a(6)+a(7)$$
$$y(2)=0+a(2)+0+a(4)+0+a(6)+0$$
$$y(3)=a(1)+0+0+a(4)+a(5)+0+0$$
$$y(4)=0+0+a(3)+a(4)+0+0+a(7)$$
$$y(5)=a(1)+a(2)+a(3)+0+0+0+0$$
$$y(6)=0+a(2)+0+0+a(5)+0+a(7)$$
$$y(7)=a(1)+0+0+0+0+a(6)+a(7)$$
$$y(8)=0+0+a(3)+0+a(5)+a(6)+0$$

Now consider the decoding k=1 of the M=8 measurements:

$$H^{-1}=1\Big/8\begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H^{-1}(k+1,\ :)=1/8[\,+1\quad -1\quad +1\quad -1\quad +1\quad -1\quad +1\quad -1\,]$$

$$z(1)=1/8(y(1)-y(2)+y(3)-y(4)+y(5)-y(6)+y(7)-y(8))$$

$$z(1)=1/2a(1)$$

Also consider the decoding k=5 of the M=8 measurements:

$$H^{-1}=1\Big/8\begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H^{-1}(k+1,\ :)=1/8[\,+1\quad -1\quad +1\quad -1\quad -1\quad +1\quad -1\quad +1\,]$$

$$z(5)=1/8(y(1)-y(2)+y(3)-y(4)-y(5)+y(6)-y(7)+y(8))$$

$$z(5)=1/2a(5)$$

The complete decoded N=7 element set consists of:

z(1)=(1/2)a(1)
z(2)=(1/2)a(2)
z(3)=(1/2)a(3)
z(4)=(1/2)a(4)
z(5)=(1/2)a(5)
z(6)=(1/2)a(6)
z(7)=(1/2)a(7)

The estimates are provided directly by a multiplication by 2.

Known Encoding (gain=0) Example with "Lightly Loaded" Hadamard Encoding

As a second example consider the case of an N=5 element array. Again, the smallest order Hadamard matrix than can be used is M=8:

Now consider the encoding of element n=1 during each of the M measurements:

$$H=\begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(:,n+1)=\begin{bmatrix} +1 \\ -1 \\ +1 \\ -1 \\ +1 \\ -1 \\ +1 \\ -1 \end{bmatrix}\begin{matrix} \text{Measurement 1} & \text{Reference State} \\ \text{Measurement 2} & \text{Off State} \\ \text{Measurement 3} & \text{Reference State} \\ \text{Measurement 4} & \text{Off State} \\ \text{Measurement 5} & \text{Reference State} \\ \text{Measurement 6} & \text{Off State} \\ \text{Measurement 7} & \text{Reference State} \\ \text{Measurement 8} & \text{Off State} \end{matrix}$$

Also consider the encoding of element n=5 during each of the M measurements:

$$H=\begin{bmatrix} +1 & +1 & +1 & +1 & +1 & \text{[illegible]} & +1 & +1 \\ +1 & -1 & +1 & -1 & +1 & \text{[illegible]} & +1 & -1 \\ +1 & +1 & -1 & -1 & +1 & \text{[illegible]} & -1 & -1 \\ +1 & -1 & -1 & +1 & +1 & \text{[illegible]} & -1 & +1 \\ +1 & +1 & +1 & +1 & -1 & \text{[illegible]} & -1 & -1 \\ +1 & -1 & +1 & -1 & -1 & \text{[illegible]} & -1 & +1 \\ +1 & +1 & -1 & -1 & -1 & \text{[illegible]} & +1 & +1 \\ +1 & -1 & -1 & +1 & -1 & \text{[illegible]} & +1 & -1 \end{bmatrix}$$

$$H(:,n+1)=\begin{bmatrix} +1 \\ -1 \\ +1 \\ -1 \\ -1 \\ +1 \\ -1 \\ +1 \end{bmatrix}\begin{matrix} \text{Measurement 1} & \text{Reference State} \\ \text{Measurement 2} & \text{Off State} \\ \text{Measurement 3} & \text{Reference State} \\ \text{Measurement 4} & \text{Off State} \\ \text{Measurement 5} & \text{Off State} \\ \text{Measurement 6} & \text{Reference State} \\ \text{Measurement 7} & \text{Off State} \\ \text{Measurement 8} & \text{Reference State} \end{matrix}$$

Now consider the measurement m=1 from all of the N elements:

$$H = \begin{bmatrix} +1 & \text{[illegible]} & \text{[illegible]} & \text{[illegible]} & \text{[illegible]} & \text{[illegible]} & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(m, :) = [\,+1 \quad +1 \quad +1 \quad +1 \quad +1 \quad +1 \quad +1 \quad +1\,]$$

$$y(1) = 0 + a(1) + a(2) + a(3) + a(4) + a(5) + 0 + 0$$

Also consider the measurement m=5 from all of the N elements:

$$H = \begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & \text{[illegible]} & \text{[illegible]} & \text{[illegible]} & \text{[illegible]} & \text{[illegible]} & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H(m, :) = [\,+1 \quad +1 \quad +1 \quad +1 \quad -1 \quad -1 \quad -1 \quad -1\,]$$

$$y(5) = 0 + a(1) + a(2) + a(3) + 0 + 0 + 0 + 0$$

The complete superposed M=8 measurement set consists of:

$$y(1) = a(1) + a(2) + a(3) + a(4) + a(5)$$
$$y(2) = 0 + a(2) + 0 + a(4) + 0$$
$$y(3) = a(1) + 0 + 0 + a(4) + a(5)$$
$$y(4) = 0 + 0 + a(3) + a(4) + 0$$
$$y(5) = a(1) + a(2) + a(3) + 0 + 0$$
$$y(6) = 0 + a(2) + 0 + 0 + a(5)$$
$$y(7) = a(1) + 0 + 0 + 0 + 0$$
$$y(8) = 0 + 0 + a(3) + 0 + a(5)$$

Now consider the decoding k=1 of the M=8 measurements:

$$H^{-1} = \frac{1}{8}\begin{bmatrix} +1 & +1 & +1 & +1 & +1 & +1 & +1 & +1 \\ \text{[illegible]} & \text{[illegible]} & \text{[illegible]} & \text{[illegible]} & \text{[illegible]} & \text{[illegible]} & \text{[illegible]} & \text{[illegible]} \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ +1 & -1 & +1 & -1 & -1 & +1 & -1 & +1 \\ +1 & +1 & -1 & -1 & -1 & -1 & +1 & +1 \\ +1 & -1 & -1 & +1 & -1 & +1 & +1 & -1 \end{bmatrix}$$

$$H^{-1}(k+1, :) = 1/8[\,+1 \quad -1 \quad +1 \quad -1 \quad +1 \quad -1 \quad +1 \quad -1\,]$$

$$z(1) = 1/8(y(1) - y(2) + y(3) - y(4) + y(5) - y(6) + y(7) - y(8))$$

$$z(1) = 1/2a(1)$$

Also consider the decoding k=5 of the M=8 measurements:

$$H^{-1} = \frac{1}{8}\begin{bmatrix} +1 & +1 & +1 & +1 & +1 & +1 & +1 & +1 \\ +1 & -1 & +1 & -1 & +1 & -1 & +1 & -1 \\ +1 & +1 & -1 & -1 & +1 & +1 & -1 & -1 \\ +1 & -1 & -1 & +1 & +1 & -1 & -1 & +1 \\ +1 & +1 & +1 & +1 & -1 & -1 & -1 & -1 \\ \text{[illegible]} & \text{[illegible]} & \text{[illegible]} & \text{[illegible]} & \text{[illegible]} & \text{[illegible]} & \text{[illegible]} & \text{[illegible]} \\ +1 & +1 & -1 & -1 & -1 & -1 & +1 & +1 \\ +1 & -1 & -1 & +1 & -1 & +1 & +1 & -1 \end{bmatrix}$$

$$H^{-1}(k+1, :) = 1/8[\,+1 \quad -1 \quad +1 \quad -1 \quad -1 \quad +1 \quad -1 \quad +1\,]$$

$$z(5) = 1/8(y(1) - y(2) + y(3) - y(4) - y(5) + y(6) - y(7) + y(8))$$

$$z(5) = 1/2a(5)$$

The complete decoded N=5 element set consists of:

z(1)=(1/2)a(1)
z(2)=(1/2)a(2)
z(3)=(1/2)a(3)
z(4)=(1/2)a(4)
z(5)=(1/2)a(5)

The estimates are provided directly by a multiplication by 2.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for calibrating a remote system having a plurality of N elements, N being a positive integer number, an input signal to each of said N elements being processed according to beamforming bits to determine the output of a corresponding element, the output of the plurality of N elements being a composite signal, the method comprising the steps of:

(a) transmitting a calibration signal to input the plurality of N elements of the remote system;

(b) selecting a first set of beamforming bits for each of the plurality of N elements based upon entries of a predetermined invertible matrix;

(c) processing the calibration signal at the remote system according to the beamforming bits for each of the N plurality of elements;

(d) detecting a reference signal from the remote system and the composite signal transmitted from the N plurality of elements based on the first set of beamforming bits;

(e) repeating steps (b)–(d) for successive sets of beamforming bits to generate a set of signals; and (f) processing the set of signals for generating calibration data for each of the N plurality of elements of the remote system.

2. The method of claim 1, wherein said remote system comprises a phased array system and wherein each of the N plurality of elements comprises an individual antenna in the phased array system.

3. The method of claim 2, wherein the beam forming bits are selected from a group consisting of 22½ degree phase shift bit, 45 degree phase shift bit, 90 degree phase shift bit, 180 degree phase shift bit, and an attenuation bit.

4. The method of claim 1, further comprising the step of splitting the calibration signal into N+1 signals, N signals being input into the corresponding N plurality of signals and the remaining signal being transmitted as the reference signal.

5. An apparatus for calibrating a remote system having a plurality of N elements, N being a positive integer number, an input signal to each of said N elements being processed according to beamforming bits to determine the output of a corresponding element, the output of the plurality of N elements being a composite signal, said apparatus comprising:

means for transmitting a calibration signal to input the plurality of N elements of the remote system;

means for selecting successive sets of beamforming bits for each of the plurality of N elements based upon entries of a predetermined invertible matrix;

processing the calibration signal at the remote system according each of the sets of beamforming bits for each of the N plurality of elements;

means for detecting a reference signal from the remote system and the composite signal transmitted from the N plurality of elements based on each of the sets of beamforming bits to generate a set of signals; and means for processing the set of signals for generating calibration data for each of the N plurality of elements of the remote system.

6. The apparatus of claim 5, wherein said remote system comprises a phased array system and wherein each of the N plurality of elements comprises an individual antenna in the phased array system.

7. The apparatus of claim 6, wherein the beam forming bits are selected from a group consisting of 22½ degree phase shift bit, 45 degree phase shift bit, 90 degree phase shift bit, 180 degree phase shift bit, and an attenuation bit.

8. The apparatus of claim 1, further comprising a signal splitter for splitting the calibration signal into N+1 signals, N signals being input into the corresponding N plurality of signals and the remaining signal being transmitted as the reference signal.

9. The apparatus of claim 1, wherein the predetermined invertible matrix is a Hadamard matrix.

* * * * *